US006681834B2

(12) United States Patent
Koda et al.

(10) Patent No.: US 6,681,834 B2
(45) Date of Patent: Jan. 27, 2004

(54) INJECTION METHOD FOR MELTED METALS

(75) Inventors: Toshiyasu Koda, Sakaki-machi (JP); Mamoru Miyagawa, Sakaki-machi (JP); Yuji Hayashi, Sakaki-machi (JP)

(73) Assignee: Nissei Plastic Industrial Co., Ltd., Nagano-ken (JP)

( * ) Notice: Subject to any disclaimer, the term of this patent is extended or adjusted under 35 U.S.C. 154(b) by 0 days.

(21) Appl. No.: 10/100,209

(22) Filed: Mar. 18, 2002

(65) Prior Publication Data

US 2002/0092641 A1 Jul. 18, 2002

Related U.S. Application Data

(63) Continuation of application No. 09/740,614, filed on Dec. 19, 2000.

(30) Foreign Application Priority Data

Dec. 24, 1999 (JP) ..... 11-367822

(51) Int. Cl.[7] ..... B22D 17/00
(52) U.S. Cl. ..... 164/113; 164/312
(58) Field of Search ..... 164/312, 316, 164/113, 900; 366/78, 79

(56) References Cited

U.S. PATENT DOCUMENTS 5,040,589 A * 8/1991 Bradley et al. ..... 164/113
5,501,266 A * 3/1996 Wang et al. ..... 164/113
5,680,894 A 10/1997 Kilbert ..... 164/312
5,685,357 A * 11/1997 Kato et al. ..... 164/113
5,711,366 A 1/1998 Mihelich et al. ..... 164/312
5,983,976 A * 11/1999 Kono ..... 164/113
5,983,978 A 11/1999 Vining et al. ..... 164/312
6,588,486 B1 * 7/2003 Takayama et al. ..... 164/113

* cited by examiner

*Primary Examiner*—M. Alexandra Elve
*Assistant Examiner*—Kevin P. Kerns
(74) *Attorney, Agent, or Firm*—Weingarten, Schurgin, Gagnebin & Lebovici LLP

(57) ABSTRACT

An injection method and apparatus for melted metals are provided to transfer the metals, to melt them by external heat, and to meter and degas the metals by employing a reservoir to reserve metals in liquid phase. The injection apparatus includes a heating cylinder having a fore end portion which communicates with a nozzle member and of which internal diameter is made smaller to serve as a metering chamber, and an injection screw installed within the heating cylinder to be movable and rotational. A reservoir for reserving melted metals in liquid phase has an axis provided between the plunger and a feeding portion containing a screw flight around the axis. A projected portion for limiting the feeding of granular metals flowing to the reservoir and for preventing the metals in liquid phase from flowing backward during injection is provided on a boundary between the feeding portion and the reservoir.

1 Claim, 4 Drawing Sheets

INJECTION METHOD FOR MELTED METALS

CROSS REFERENCE TO RELATED APPLICATIONS

This application is a continuation of U.S. application Ser. No. 09/740,614, entitled INJECTION APPARATUS FOR MELTED METALS, filed Dec. 19, 2000 and claiming benefit of foreign priority under Rule 55 of Japanese Application No. 11-367,822 filed Dec. 24, 1999, the disclosures of which are incorporated by reference herein.

BACKGROUND OF THE INVENTION

1. Field of the Invention

The present invention relates to an injection apparatus for melted metals used for injection molding nonferrous metals having a low melting point, such as zinc, magnesium, or alloy thereof, completely melted in liquid phase.

2. Detailed Description of the Prior Art

Attempts have been made to completely melt nonferrous metals having a low melting point so as to allow injection molding in liquid phase. Like in the case of injection molding of plastics, the molding method adopts a heating cylinder having inside an injecting screw, which is allowed to rotate and move along the axial direction. Granular metals supplied from the rear portion of the heating cylinder are heated and melted completely by shear heat and external heat while being transferred toward the fore end of the heating cylinder by means of rotation of the screw. After a quantity of the melted metals in liquid phase is metered in the fore portion of the heating cylinder, the metals are injected into a mold through the nozzle attached to the tip end of the heating cylinder by the forward movement of the screw.

Problems occurring in case of adopting the foregoing injection molding for the metals are, for example, difficulty on the transfer of the material by means of rotation of the screw, the maintenance of the temperature of the melted metals in liquid phase, unstable metering, or the like.

A melted plastic material has a high viscosity, and transfer of the melted plastic material by means of rotation of the screw is allowed mainly because a friction coefficient at the interface of the melted plastic material and the screw is smaller than a friction coefficient at the interface of the melted plastic material and the inner wall of the heating cylinder, and therefore, a difference in friction coefficient is produced between the two interfaces.

In contrast, the metal completely melted in liquid phase has such a low viscosity compared with the plastic material that a difference in friction coefficient is hardly produced between the above two interfaces. Hence, a transfer force such as the one produced with the melted plastic material by means of rotation of the screw is not readily produced.

However, a transfer force is produced with the metals in solid state and in a high viscous region where the metals are in a semi-molten (liquid-solid) state during the melting process. Thus, the metals can be transferred by means of rotation of the screw up to that region. Nevertheless, as the metals are further melted, the viscosity thereof drops with an increasing ratio of the liquid phase, and the transfer force produced by the screw grooves between the adjacent screw flights decreases, thereby making it difficult to supply the melted metals in a stable manner to the fore end portion of the heating cylinder by means of rotation of the screw.

Because the melted plastic material has a high viscosity, it is stored in the fore end of the heating cylinder by means of rotation of the screw, while at the same time, a material pressure pushing the screw backward is produced as a reaction. By controlling the screw retraction caused by the material pressure, a constant quantity of the melted material can be metered each time.

However, the metals in the low-viscous liquid phase cannot produce a pressure high enough to push the screw backward. Thus, the screw retraction by the material pressure hardly occurs, and if the metals are reserved in the fore end portion by means of rotation of the screw alone, a quantity thereof undesirably varies, thereby making it impossible to meter a constant quantity each time.

In addition, the metals have a far larger specific gravity compared with the plastics, and have a low viscosity and fluidity in liquid phase. For this reason, when allowed to stand by stopping rotation of the screw, the metals in liquid phase in the heating cylinder placed in a horizontal position leak into the semi-molten (liquid-solid) region in the rear portion through a clearance formed between the screw flights and the heating cylinder. Consequently, the metal material metered in the fore end portion causes a back flow onto the periphery of the fore portion of the screw through the opened ring valve, and the quantity thereof is undesirably reduced.

The liquid level in the fore end portion is lowered with the decreasing reserved quantity. For this reason, a gaseous phase (space) that makes the metering unstable is generated at the upper portion of the fore end portion. In addition, the leaked liquid phase material increases its viscosity in the semi-molten (liquid-solid) region as its temperature drops, or turns into solid depending on the heating condition in the semi-molten (liquid-solid) region, thereby forming weirs in the screw grooves. This poses a problem that the granular material supplied from the feeding opening provided behind the weir cannot be transferred readily by means of rotation of the screw.

SUMMARY OF THE INVENTION

The present invention is designed to solve the problems stated above in the injection molding of the metals in liquid phase. An object of the present invention is to provide a new injection apparatus which can easily and smoothly transfer the metals, melt them by the external heat, meter and degas by employing a reservoir to reserve metals in liquid phase for the injection screw, and a method for injection molding.

In order to achieve the above-mentioned object, the present invention according to the first aspect provides an injection apparatus for melted metals, comprising a heating cylinder having a fore end portion which communicates with a nozzle member and of which internal diameter is made smaller to serve as a metering chamber having a required length, and an injection screw installed within the heating cylinder to be movable and rotational, a tip end of the injection screw being formed in a plunger having a diameter which is almost the same as that of the metering chamber and can insert into the metering chamber while keeping a clearance for sliding, wherein a reservoir consisting of a portion is provided between the plunger and a feeding portion containing screw flight around the portion.

Moreover, the present invention provides the injection apparatus for melted metals according to the foregoing aspect, wherein a projected portion for limiting the feeding of granular metals flowing from the feeding portion to the reservoir with metals in liquid phase and for preventing the metals in liquid phase reserved in the reservoir from flowing backward when the injection screw moves forward is provided on a boundary between said feeding portion and the reservoir.

The present invention further provides the injection apparatus for melted metals according to either of the foregoing aspects, wherein the screw flight of the feeding portion is provided in such a manner that screw groove of screw end is placed immediately below the feeding opening at the rearmost position of the screw in the heating cylinder, and that the screw end is placed in front of the feeding opening at the foremost position of the screw to close the feeding opening with the rear portion of the screw portion without screw flights, and to be capable of achieving transferring of the granular metals by the screw rotation at the rearmost position of the screw.

The present invention further provides the injection apparatus for melted metals according to the foregoing aspects, wherein the screw flight of the feeding portion is provided in such a manner that a screw groove of a screw end is placed immediately below the feeding opening at the foremost position of the screw in the heating cylinder, and that the screw end is placed behind the feeding opening at the rearmost position of the screw to be capable of achieving transferring of the granular metals by the screw rotation at the foremost position of the screw.

Moreover, the present invention provides the injection apparatus for melted metals according to the first aspect, wherein the plunger is provided with a heat-resistant seal ring therearound, and a flow-through hole is formed therein from a ring groove for fitting the seal ring to a conical end of the plunger.

The present invention further provides the injection apparatus for melted metals according to any of the foregoing aspects, wherein the heating cylinder is installed with an inclination and positioning the feeding opening higher than the nozzle to allow the metals in liquid phase to flow down into the reservoir by its own weight.

In the construction stated above, a reservoir for the metals in liquid phase is provided between the plunger as a fore end portion and a feeding portion. By means of retracting the injection screw, the metal temporarily reserved in the reservoir is allowed to be reserved in the above-mentioned metering chamber. Thereby, the next feed of metals is completely melted and the temperature thereof is maintained while they are maintained in the reservoir even if the metals are melted by the external heat. As a result, the temperature of metals can be kept constant.

Since a compressing portion to generate shear heat is unnecessary, the depth of the screw grooves between the screw flights can be made constant so as to feed the metals smoothly. Thereby the metals evenly contact the inner surface of the heating cylinder so that a fluctuation of temperature rarely happens. Since the most part of the metals melt into liquid phase while they reach to the projected portion on the boundary to the reservoir, and large granules which are incompletely melted are prevented from flowing into the reservoir by means of the projected portion, the metals in the reservoir are melted completely into the liquid phase and always ensured that they will be reserved into the metering chamber.

Furthermore, in the construction stated above, while the screw moves forward and the feeding opening is being closed with the axis, the feeding of the metals will be automatically limited upon the start of injection. It prevents congestion of the metals in the screw grooves in the rear of the screw.

Thereby, a friction by rotation and sliding to the screw is decreased, which stabilizes melting and injecting of the metals to improve the quality of molded products.

The heating cylinder is inclined downward so as to reserve the melted metals in the reserving space surrounding the portion in the front portion of the heating cylinder. Therefore, even if the metals are in the liquid phase of a low viscosity, they will not flow backward so that the reserved amount will not fluctuate. In addition to it, since the rotation of the screw supplies the metals in liquid phase, in spite of injection molding the metals in liquid phase, a stable quality of molded metal products can be produced.

The nature, principle, and utility of the invention will become more apparent from the following detailed description when read in conjunction with the accompanying drawings in which like parts are designated by like reference numerals or characters.

PREFERRED EMBODIMENTS OF THE INVENTION

Figure 1:
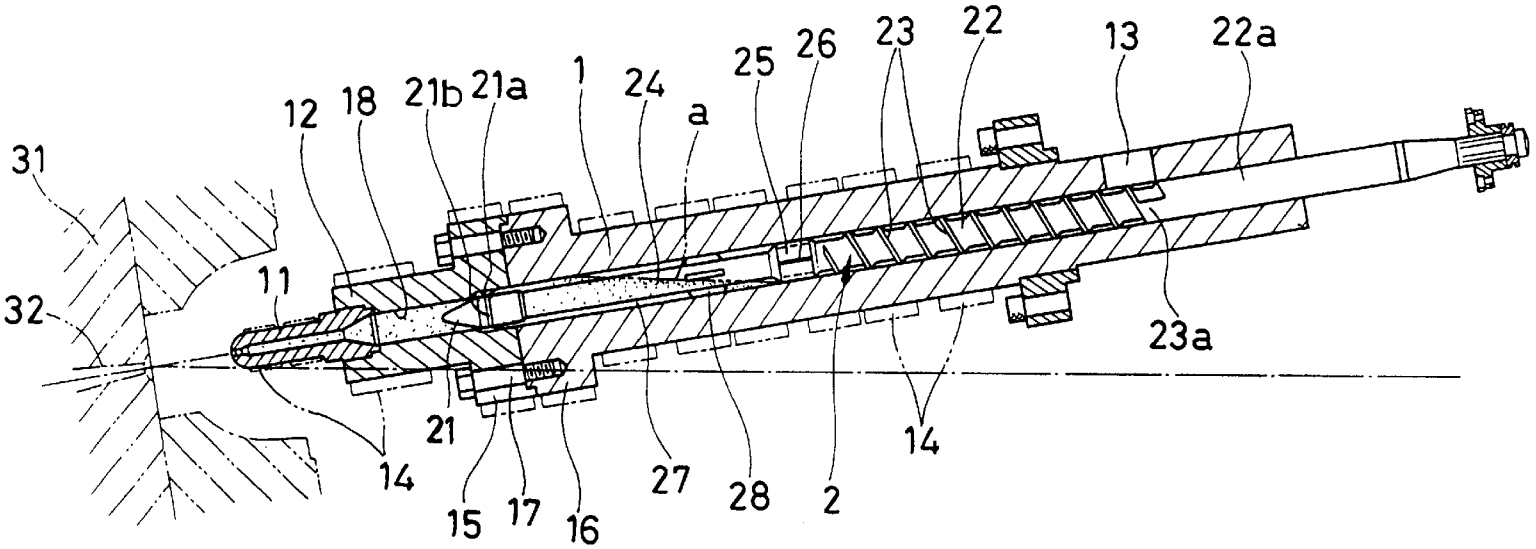
FIG. 1 is a longitudinal sectional side view illustrating an injection apparatus for melted metals according to the present invention.

The figures show one embodiment of the injection apparatus according to the present invention and reference numeral 1 denotes a heating cylinder, and reference numeral 2 denotes an injection screw installed within the heating cylinder 1.

The heating cylinder 1 is provided with a fore end member 12 to which a nozzle member 11 is screwed on the end thereof, and has a feeding opening 13 on the rear part thereof for feeding the granular metals. On the circumference of the heating cylinder 1 from the nozzle member 11 and the fore end member 12 to the feeding opening 13, band heaters 14 are provided at regular intervals.

Figure 6:
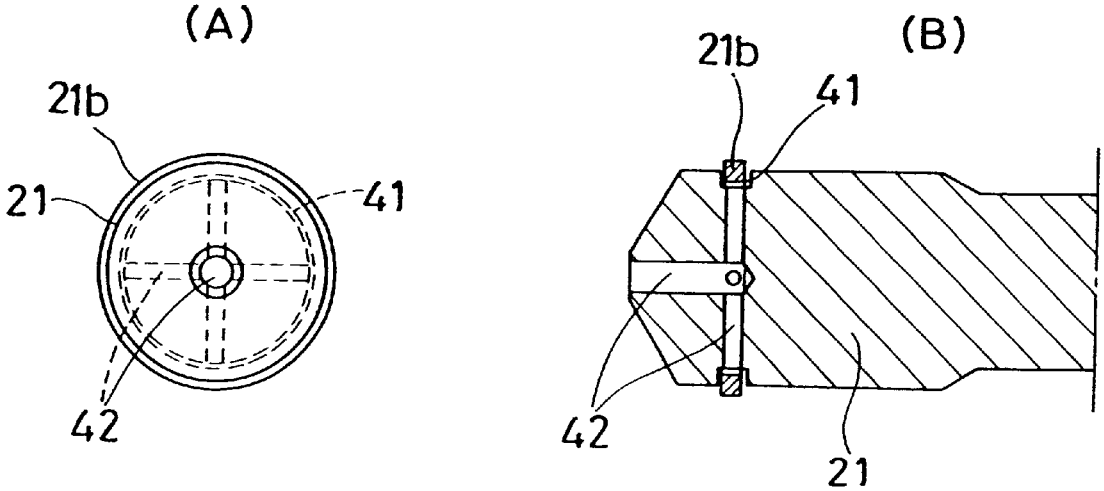
FIG. 6 is an enlarged sectional view of the tip end of the heating cylinder.

The fore end member 12 is mounted to the heating cylinder 1 as a fore end portion by mating a flange 15 formed in the rear end of the fore end member 12 with a flange 16 formed in the end of the heating cylinder 1, and fixed with bolts 17. The internal diameter of the front member 12 communicating with the nozzle member 11 is smaller than that of the heating cylinder 1 inserted with the injection screw 2 by 8–15%. This inside of the front member 12 serves as a metering chamber 18 having a required length of the fore end portion of the heating cylinder 1. At the opening of the metering chamber 18, as enlarged and shown in FIG. 6, a plurality of grooves 21*a* are concavely provided at regular intervals.

In such seal ring 21*b*, when the injection screw 2 moves forward, the pressure caused by pressing metals by the end of the plunger 21 affects the seal ring 21*b* gently fitted to the ring groove 41 via the flow-through hole 42 and presses it outwardly. Thereby the seal ring 21*b* is expanded so that it is pressed to the surface of the metering chamber 18, which prevents the melted metals from flowing backward from the clearance for sliding.

With the backward moving of the injection screw 2, the expanded seal ring 21*b* will be shrunk by the negative pressure in the metering chamber, and then, the clearance is formed again which the melted metals flows.

The tip end portion of the injection screw 2 is formed in the plunger 21. This plunger 21 has a diameter that can insert into the metering chamber 18 with keeping the clearance for sliding and a conical surface that fits to the funnel-shaped front surface of the metering chamber 18. A seal ring 21*b* is provided to the circumference of the plunger 21 to prevent the metals from flowing backward from the sliding clearance at injection. For the seal ring 21*b*, a piston ring of special steel with heat resistance can be applied.

Figure 2:
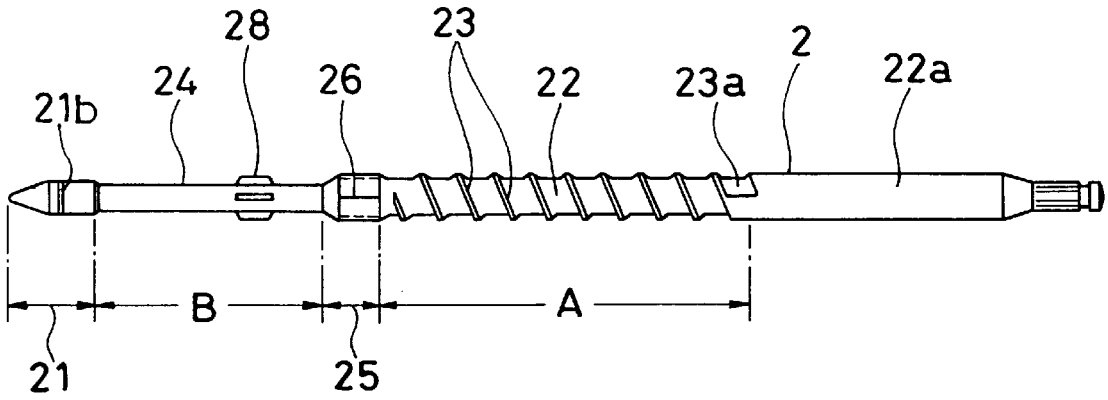
FIG. 2 is a side view showing an injection screw installed in the injection apparatus according to the present invention.

As shown in FIG. 2, there is a reservoir B consisting of the axis 24 between the above-mentioned plunger 21 and a feeding portion A containing screw flight 23 around the portion 22. The outer diameter of the screw flight 23 is almost the same as that of the heating cylinder 1. At the rearmost position of the injection screw (where the injection screw 2 retracts), from the position where the screw groove 23*a* of the screw end is placed immediately below the feeding opening 13 to the projected portion 25 formed on the boundary with the reservoir B, the screw flight 23 is formed at a constant pitch around the portion 22.

The outer diameter of the projected portion 25 is the same as that of the screw flight 23. On the side of the projected portion 25, slits 26 are cut along the portion in order to limit the feeding of the metal granules of the diameter larger than 2 mm transporting from the feeding portion A to the reservoir B. The slits 26 limit the size of the metal granules in semi-molten (liquid-solid) state which flow from the feeding portion A to the reservoir B with the metals in liquid phase so that the metals are completely melted by the external heat in the reservoir B. When the injection screw 2 moves forward, the projected portion 25 prevents the metals from going to semi-molten state caused by the metals in liquid phase flowing backward from the reservoir B to the feeding portion A.

While the other limitation of the metals is omitted in the figures, they may be through holes of a diameter of about 1 mm penetrated on the projected portion 25 at regular intervals, or a clearance formed by reducing the outer diameter of the projected portion 25 smaller than the internal diameter of the heating cylinder 1.

The diameter of the portion 24 of the reservoir B is smaller than that of the plunger 21. Therefore, a reserving space 27 deeper than the screw grooves between the screw flights in the feeding portion A is formed between the internal wall of the heating cylinder 1 and the portion 24. Thereby, in the length of the reservoir B, the metals in liquid phase of the amount for the next feeding can be reserved. Incidentally, reference numeral 28 denotes a supporting member for the portion 24 and serves as an impeller.

Figure 4:
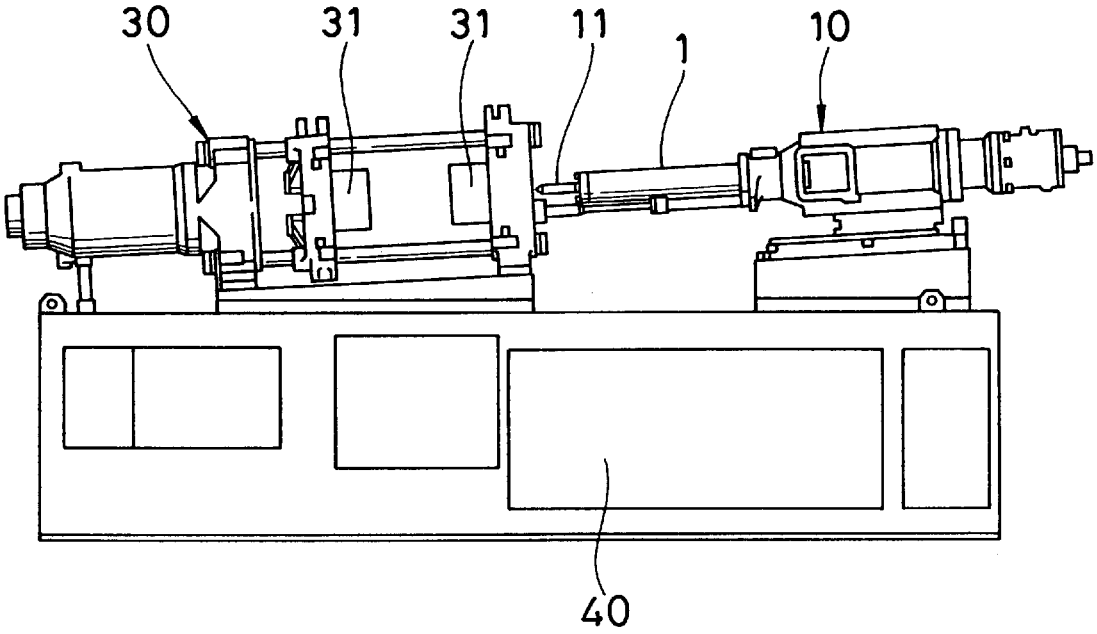
FIG. 4 is a side view showing a molding apparatus installing the injection apparatus according to the present invention.

The injection apparatus in the construction stated above is used by being installed with an inclination and positioning the feeding opening 13 higher than the nozzle 11. Thereby, it allows the metals in liquid phase in the heating cylinder 1 to flow down into the reserving space 27 by its own weight and be stored in the metering chamber 18 at every injection molding. In the installation of the injection apparatus with an inclination, the nozzle member 11 and the sprue 32 of the mold 31 are aligned without bending to make nozzle-touching. For example, as shown in FIG. 4, the injection apparatus 10 and a clamping apparatus 30 are installed on the table 40 at a same angle (3–10 degrees) or only the injection apparatus is installed on the table with an inclination (not shown), whichever is applicable.

In the injection apparatus 10 stated above, the injection screw 2 comprising from the feeding portion A, the reserving portion B and the plunger 21 does not have a compressing portion which is incorporated in the normal injection screw for primarily melting materials by the shear heat. Therefore, the metals are exclusively melted by externally heating from the band heaters 14 around the heating cylinder 1 (for example, the temperature for Mg is 610° C. or higher). The melting by external heat and the metering of the metals are performed while the end of the nozzle member 11 is touched with the mold 31. The metals remained in the fore end of the nozzle member 11 that is nozzle-touched with the mold so as to cool the metals are solidified. As the result, the fore end of the nozzle member 11 is plugged.

Figure 3:
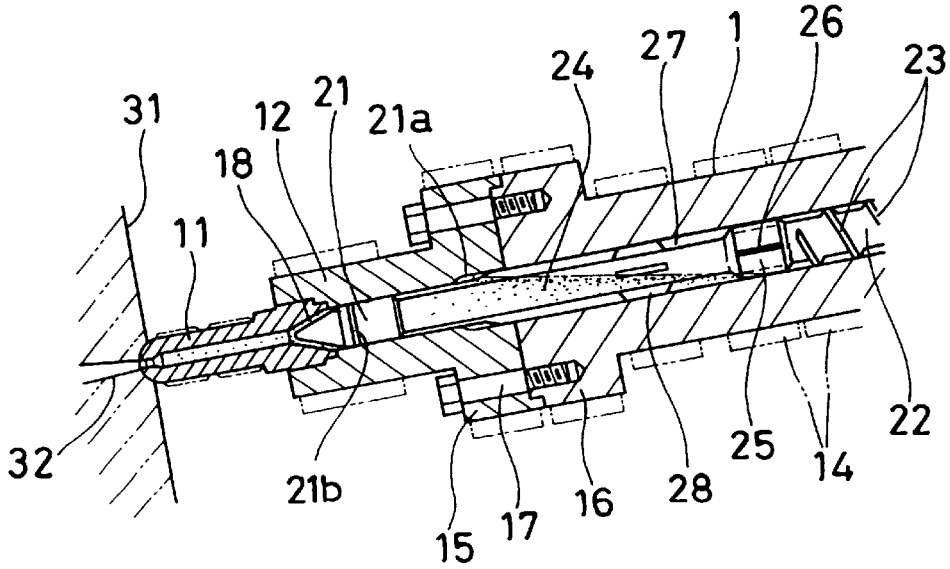
FIG. 3 is a longitudinal sectional side view illustrating a front portion of the injection apparatus when the injection filling is completed.

As shown in FIG. 3, the injection screw 2 stops in order to leave the required amount of the metals in liquid phase as buffer after injection filling. When the injection screw 2 is forced to go backward for a set distance, the pressure in the metering chamber 18 goes negative (decompressed or vacuum). However, once the plunger 21 moves back to the set position and the metering chamber 18 communicates with the reservoir B by means of the grooves 21*a*, the metals in liquid phase temporarily stored in the reservoir B for the next feed will be sucked and filled in the metering chamber 18.

In the feeding portion A, in spite of the action of the injection screw 2, the metals existing in the screw grooves between the screw flights 23 are continuously melted by the external heat, and the flow into the reservoir B of the completely melted metals continues. Furthermore, when the injection screw 2 goes backward, the screw grooves 23*a* of the screw end comes to the position immediately below the feeding opening 13. Thereby, the feeding opening 13 which is closed by the rear portion 22*a* of the screw portion without screw flights with forwarding of the injection screw 2 is opened.

When the injection screw 2 is rotated at the position where the screw 2 stops, the granular metals in the feeding opening 13 will be led forward over the heating cylinder 1 as fresh material by the rotation of the screw flights 23. In the middle, the metals become semi-molten (liquid-solid) state by melting with the external heat from the heating cylinder 1, containing the metals in solid phase and liquid phase.

In this case, when the un-molten metals fill in the screw grooves between the screw flights, torque of the screw rotation rises and the screw rotation becomes unstable. To avoid this, the feeding will be controlled. By means of the limitation of the feeding, the amount of the metals in the grooves is small so as not to shear.

For the metals with the tendency of oxidization, it is desirable to melt the metals in an inert gas by supplying the inert gas such as argon gas from the feeder through the feeding opening 13 to the heating cylinder 1.

The frequency of the screw rotation is counted by the rotation detector normally used in the injection molding apparatus during a predetermined period counted from the beginning of the rotation. It is preferable to control the frequency of the screw rotation by such a frequency calculated from the screw rotation frequency by rotation period.

It is also preferable to apply a certain back pressure to prevent the screw from going backward during the rotation.

Most part of the metals fed from the feeding portion A becomes metals in liquid phase until they reach to the projected portion 25. When the ratio of the liquid phase increases in the heating cylinder 1, the metals with a viscosity similar to that of the molten metal tends to stay in the lower part of the screw at its gravity in the heating cylinder horizontally installed. However, the heating cylinder 1 is inclined downward along with the screw 2, which allows the metals in liquid phase to flow into the reservoir B from the slits 26 of the projected portion 25, in addition to the effect of the screw rotation. The un-molten granules in the melted metals that cannot pass through the slits 26 are heated while staying in the feeding portion A. Although the metals are not completely melted, such fine granules of the un-molten metals pass through the slits 26 and flow into the reservoir B. They are melted completely through the external heating and the heat exchange with the metals in liquid phase.

The metals in liquid phase flowing into the reservoir B are temporarily stored with stirring by the rotating portion 24 as the next feed because the metering chamber 18 is already filled with the metals which are temporarily stored at the previous injection. However, when the metering chamber 18 is not fully filled, the metering chamber 18 is compensated with the amount of shortage. After that, the metals are stored in the reservoir B.

The level of the metals in the reservoir B is horizontal and it is inclined to the heating cylinder 1. Therefore, gaseous phase generates above the level a so that the level cannot reach to the metering chamber 18. When the injection screw 2 is forced to retract, the metals in the reservoir B will be sucked into the metering chamber 18, the air will be involved therein. However, degassing is performed voluntarily due to the difference in the specific gravity. Therefore, it is unnecessary to degas which is required when the heating cylinder 1 is installed horizontally. These methods improve stability in metering.

Next, metering is completed after the rotation of screw stops when the set amount of the metals is stored in the reservoir B, and the injection screw 2 moves forward. The injection screw 2 for the metering moves forward until the material pressure in the metering chamber 18 reaches to set pressure predetermined in the moving distance of the screw 2, while the plunger 21 is inserted into the metering chamber 18 to shut the path or the grooves 21*a*, or to shut the clearance between the end surface of the plunger 21 and the metering chamber 18 if the grooves 21*a* are unnecessary.

Whichever the case maybe, in the process of metering, before the metals in liquid phase are pressed by the plunger 21, excess metals overflow into the reserving space 27 of the reservoir B and the metals in the metering chamber 18 are degassed again. The amount of the metals in the metering chamber 18 are quantified. The reservoir B moves forward along with the movement of the screw. Since the volume of the reserving space 27 around the axis is stable, the metals in reservoir B will not flow backward to the feeding portion A. If the metals should flow backward due to excess storage, the amount of it is controlled by the projected portion 25. The control by the projected portion 25 prevents a problem in feeding led by the semi-molten (liquid-solid) state of the metals in liquid phase in the feeding portion A.

After the completion of the metering, injection filling starts as a next process. A whole process from the start of the metering, and the injection to the completion of the injection filling is controlled by the process control. When the injection screw 2 moves forward for the injection, the metals in the metering chamber 18 are pressed by the plunger 21. With this pressure, the solidified metals plugging the end of the nozzle are forced out into the sprue 32. Thereby, the metals in liquid phase are injection filled into the mold 31.

To force the above-mentioned solidified material out, a significant pressure is necessary. The pressure is much varied with the state of the solidified material. The variation of the pressure may cause unstable injection. To stabilize the state of the solidified material by every molding, it is necessary to control the temperature of the fore end of the nozzle.

After the injection screw 2 stops in order to leave the required amount of the metals in liquid phase as buffer, injection filling will be completed. The above-mentioned feeding opening 13 is closed by the rear portion 22*a* of the screw portion without screw flights with forwarding of the screw end 23*a* (not shown), thereby the feeding of the metals is stopped.

After the completion of the injection, the injection screw 2 is stopped at the position to keep the pressure. After the completion of the keeping pressure, the process is switched to metering the metals, and then the injection screw 2 is forcedly moved backward. If necessary, the screw will be rotated one or two times before being moved backward forcedly or with being moved backward.

The clearance is formed around the heating cylinder 1, the screw flight 23, and the projected portion 25. The metals in liquid phase flow into the clearance, and heat thereof is removed via the screw during the stop of the injection screw 2 so as to leave them solid which impairs the screw 2 from moving backward. To remove the solidified metals and to smoothly move the screw 2 backward, the screw is rotated as mentioned in the previous paragraph.

In this position, the feeding opening 13 is plugged by the rear portion of the screw portion without screw flights 22*a*. Therefore, the metals will not be fed additionally.

When the injection screw 2 reaches the set position by moving backward, the injection screw 2 will stop through switching the process to the melting and metering processes. At that position, the screw rotation will start as mentioned above, at least the amount of the metals for the next feed, transferring, melting and metering consecutively happen.

Figure 7:
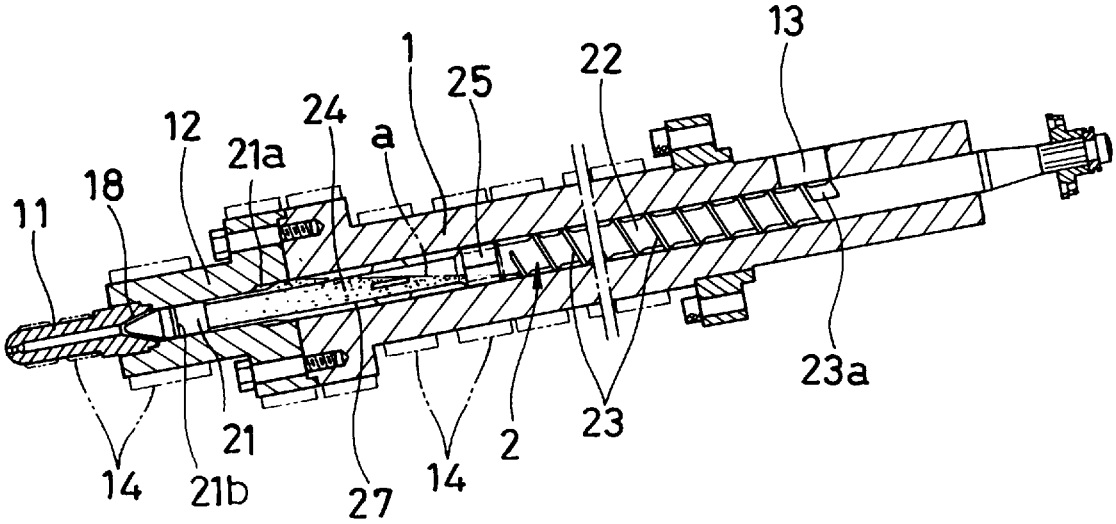
FIG. 7 is a longitudinal sectional side view of the injection apparatus of another embodiment when the injection is completed.
Figure 5:
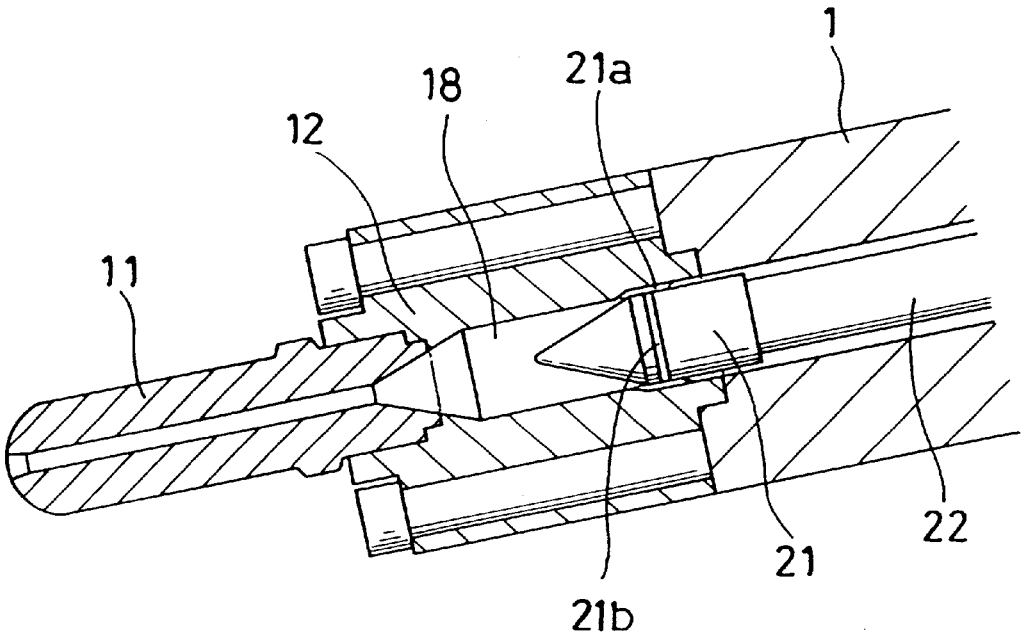
FIG. 5 is an enlarged longitudinal sectional side view of the heating cylinder.

In the above-mentioned embodiment, the injection screw 2 is rotated after moving the injection screw 2 forcedly, the metals will be fed and melted. Once the injection screw 2 is moved forcedly, it is possible to feed the metals by rotating the screw earlier. In this case, it is embodied with the following construction. As shown in FIG. 7, at the foremost position of the injection screw 2, from the position where the groove 23*a* of the screw end is below the feeding opening 13 to the projected portion 25 formed in the boundary with the reservoir B, the screw flights 23 can be integrated around the portion 22 at a constant pitch.

In such an embodiment, the feed of the metals, transferring, and melting by the rotation of the screw, and metering and injection filling by the forward movement of the screw are same as the previously stated embodiment. The melting and storage in the reservoir B of the metals start earlier. If necessary, immediately after the injection screw 2, moves backward and reach to the set rearward position, the process will be switched to those of metering and injection.

It permits the molding cycle to be shortened.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A metering and injection method for melted metals, comprising the steps of:

providing an inclined in-line injection apparatus comprising:

an inclined heating cylinder having a fore end portion and a rear end portion, the rear end portion having a first internal diameter and the fore end portion communicating with a nozzle member and having a second internal diameter, smaller than the first internal diameter, so that the fore end portion serves as a metering chamber having a required length; and an injection screw installed within the heating cylinder so that it is movable and rotatable, the injection screw comprising:

a tip end, formed as a plunger having a diameter approximately the same as the second diameter and insertable into the metering chamber while keeping a clearance for sliding;

a mid portion wherein a reservoir for the melted metal is formed between a first portion and an inner wall of the heating cylinder, the first portion being free of screw flights and having an external diameter smaller than the second internal diameter; and a feeding portion containing a screw flight having an external diameter approximately equal to the first internal diameter around a second portion for receiving and melting metal materials, the mid portion positioned between the tip end and the feeding portion;

inserting retractably the plunger into the metering chamber;

accumulating the metal materials, melted in the feeding portion by an external heater of the heating cylinder, in the reservoir utilizing gravity from a slope of the inclined heating cylinder;

pulling a metered amount of the melted metal materials into the metering chamber from the reservoir by a negative pressure on the metering chamber side generated by a forced backward movement of the injection plunger; and injecting the metered amount of the melted metal material by moving the injection plunger forward toward the nozzle member.

* * * * *

UNITED STATES PATENT AND TRADEMARK OFFICE

CERTIFICATE OF CORRECTION

PATENT NO. : 6,681,834 B2
DATED : January 27, 2004
INVENTOR(S) : Toshiyasu Koda et al.

It is certified that error appears in the above-identified patent and that said Letters Patent is hereby corrected as shown below:

Title page,
Item [75], Inventors, should read as follows:

-- Toshiyasu Koda, Nagano (JP);
Mamoru Miyagawa, Nagano (JP);
Yuji Hayashi, Nagano (JP) --;

Column 3,
Line 50, "Since the most part of the" should read -- Since most part of --; and Column 6,
Line 48, "middle" should read -- midway --.

Signed and Sealed this

Twenty-eighth Day of December, 2004

JON W. DUDAS
*Director of the United States Patent and Trademark Office*